United States Patent [19]

Culmer et al.

[11] 4,172,992

[45] Oct. 30, 1979

[54] CONSTANT CURRENT CONTROL CIRCUIT

[75] Inventors: Daniel D. Culmer; Ronald W. Russell, both of Sunnyvale, Calif.

[73] Assignee: National Semiconductor Corporation, Santa Clara, Calif.

[21] Appl. No.: 921,635

[22] Filed: Jul. 3, 1978

[51] Int. Cl.[2] ..... G05F 1/58

[52] U.S. Cl. ..... 323/4; 307/297; 323/19

[58] Field of Search ..... 323/1, 4, 9, 19, 22 T; 307/296 R, 297, 303, 237

[56] References Cited

U.S. PATENT DOCUMENTS

| | | | |
|---|---|---|---|
| 3,629,691 | 12/1971 | Wheatley, Jr. | 323/4 |
| 3,887,863 | 6/1975 | Brokaw | 323/19 |
| 4,029,974 | 6/1977 | Brokaw | 307/296 R |
| 4,063,149 | 12/1977 | Crowle | 323/4 |
| 4,078,199 | 3/1978 | Chapron et al. | 323/4 |

OTHER PUBLICATIONS

*Electronic Engnr.* Jun. 1977, "The Design of Constant Current Sources", pp. 85, 86.

*Primary Examiner*—Gerald Goldberg
*Attorney, Agent, or Firm*—Gail W. Woodward

[57] ABSTRACT

A pair of transistors are operated at different current densities so as to develop a differential base to emitter potential. This potential is used as a reference in a negative feedback stabilization circuit which passes a current that is regulated by the potential. The circuit can also regulate the currents flowing in a plurality of additional current sources and sinks connected thereto.

11 Claims, 2 Drawing Figures

CONSTANT CURRENT CONTROL CIRCUIT

BACKGROUND OF THE INVENTION

Constant current circuits are very useful in integrated circuit (IC) design. Many forms of current regulation and control circuitry have been developed. For example, U.S. Pat. No. 3,629,691 discloses an IC current source useful in controlling the bias on current sink transistors. U.S. Pat. No. 4,063,149 discloses a current regulating circuit that can be used to bias a plurality of current sink transistors. Both of these prior art circuits employ current amplifiers connected to a pair of transistors operating at different current densities so that the current flowing in the two transistors is regulated. The circuits develop a bias that when coupled to a transistor will cause it to sink a constant current. In both of these prior art circuits the current used in the control circuit is substantial and both circuits require additional means for power-up starting.

SUMMARY OF THE INVENTION

It is an object of the invention to provide a constant current circuit in which a small control current is employed to regulate a larger current.

It is a further object of the invention to provide an efficient current control circuit that can regulate the current flowing in a plurality of current sources and sinks.

It is a still further object of the invention to provide a constant current circuit that is self-starting without the addition of separate start-up circuit elements.

These and other objects are achieved in a circuit configured as follows. A pair of transistors are operated at different current densities. This is achieved by area ratioing, current ratioing or a combination of both. The differential base to emitter voltage ($\Delta V_{BE}$) thus produced is a constant value and is used as a reference in a negative feedback amplifier. The amplifier is connected to pass a current that is set by $\Delta V_{BE}$. The current can be made much larger than the current used to develop the $\Delta V_{BE}$ so that efficient control results. A junction field effect transistor (JFET) is included in the feedback amplifier so that the circuit is self-starting. The JFET can be of the plural drain variety to provide a plurality of regulated current sources. The circuit can also be coupled to a plurality of constant current sink transistors.

DESCRIPTION OF THE INVENTION

The circuit of the invention is intended for utilization in monolithic bipolar integrated circuits employing conventional silicon technology.

Figure 1:
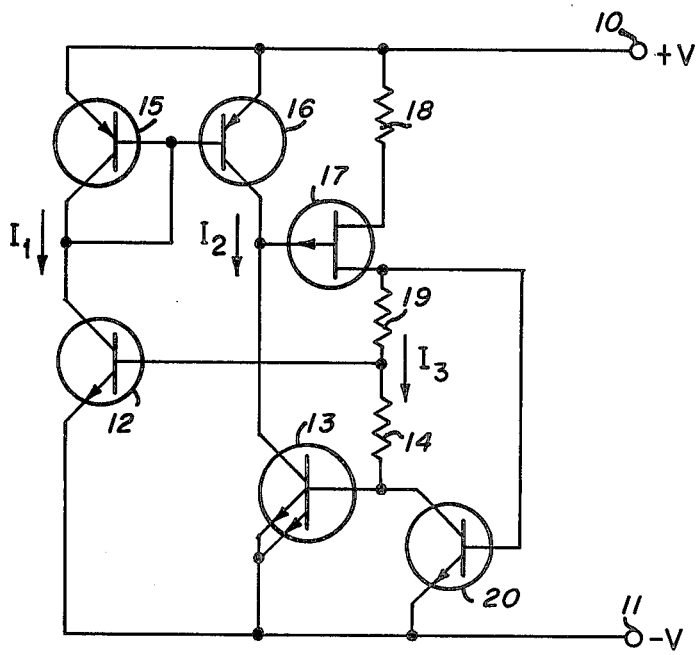
FIG. 1 is a schematic diagram of the basic circuit of the invention.

FIG. 1 is a schematic diagram of the circuit of the invention. Terminals 10 and 11 are connected to a source of potential +V and −V respectively. For any potential above about 1.2 volts and below the transistor breakdown potentials, the current flowing between terminals 10 and 11 will be substantially constant as will be described hereinafter.

For the following analysis the transistor base currents will be neglected. This does not introduce any serious errors because the typical integrated circuit NPN transistors have base to collector current gains of over 100. This means that base current will typically be less than one percent of the collector current.

Transistors 12 and 13 have their emitters connected to terminal 11 and resistor 14 is connected between their bases. Transistors 15 and 16 are connected as a conventional current mirror so that $I_2$ will track $I_1$. Transistor 12 is deliberately operated at a higher current density than transistor 13. As shown in the schematic, the emitter of transistor 13 is made larger in area than the emitter of transistor 12. If $I_1$ is made equal to $I_2$, for example, by making transistors 15 and 16 the same size, the current densities in transistors 12 and 13 will be inversely related to their emitter areas. If the current density of transistor 12 is twice that of transistor 13 a base to emitter voltage differential ($\Delta V_{BE}$) of about 18 millivolts will be developed at 300° C. (room temperature). Thus, the transistor geometry, which is closely controllable in IC processing, will establish a constant voltage across resistor 14: For this case the value of $I_3$ will be 18 mv divided by the value of resistor 14 and it will therefore be constant.

A junction field effect transistor (JFET) 17 has its source coupled to terminal 10 by resistor 18. Its drain is coupled to the base of transistor 12 by resistor 19. $I_3$ is caused to flow through JFET 17 and into the collector of transistor 20 which has its emitter connected to terminal 11. The base of transistor 20 is connected to the drain of JFET 17. Thus, the base of transistor 20 will be operated at a higher or more positive potential than the base of transistor 12 by virtue of the voltage drop across resistor 19. This means that even if transistor 20 is identical to transistor 12, $I_3$ will be larger than $I_1$ (and hence $I_2$). If desired, transistor 20 can additionally be ratioed larger than transistor 12 and $I_3$ can be made much larger than $I_1$. The total current flowing between terminals 10 and 11 will be the sum of $I_1$, $I_2$, and $I_3$. The value of resistor 14 establishes the value of $I_3$ and the value of resistor 19 establishes the ratio between $I_1$ and $I_3$. Resistor 18 permits JFET 17 to automatically establish its bias and operating point.

JFET 17 constitutes an inverting amplifier. Its gate input is connected to the current mirror transistor 16 collector and its output or drain terminal is coupled to the base of transistor 12 via resistor 19. A negative feedback loop is formed that will tend to force the circuit operating point so that the voltage across resistor 14 equals the $\Delta V_{BE}$ required between transistors 12 and 13. Additionally, transistor 20 forms a common emitter inverting amplifier stage having its base, or input, coupled to the drain of JFET 17. Its output, or collector, is coupled to the base of transistor 13. This provides negative feedback around transistor 13 to additionally stabilize the operating point of transistor 13. Thus, JFET 17 and transistor 20 comprise amplifier means acting to provide negative feedback to stabilize the operating points of both transistor 12 and 13.

It is to be noted that while the value of $\Delta V_{BE}$ will absolutely set the current at which the circuit operates, the 18 mv is developed at 300° K. This voltage has a positive temperature coefficient of about 60 microvolts per degree C. While this is not troublesome over a limited temperature range, the wide ranges typically specified for IC devices can produce substantial variations. In the embodiment of FIG. 1 the resistors (and in particular resistor 14) are in the form of a diffused region in a silicon semiconductor. Such resistors normally have a positive temperature coefficient of resistance. Accordingly, as temperature rises and $\Delta V_{BE}$ rises, the tendency is to cause $I_3$ to rise. However, the value of resistor 14 also rises thereby tending to cause $I_3$ to fall. If the temperature coefficient of resistor 14 is properly selected, the effect will be to temperature compensate the value of $I_3$ over a substantial range of temperatures.

In the foregoing description it was assumed that transistor 13 had twice the area of transistor 12 and that $I_1$ and $I_2$ were equal. The same result would occur if transistors 12 and 13 were made the same size and $I_1$ made twice as large as $I_2$. This could be achieved by the use of a ratioed current mirror. In such a device, the areas of transistors 15 and 16 could be ratioed or a resistor (not shown) could be coupled in series with the transistor 16 emitter. Also both transistors 15 and 16 emitters could be provided with different value resistors (not shown) to ratio $I_1$ to $I_2$.

Figure 2:
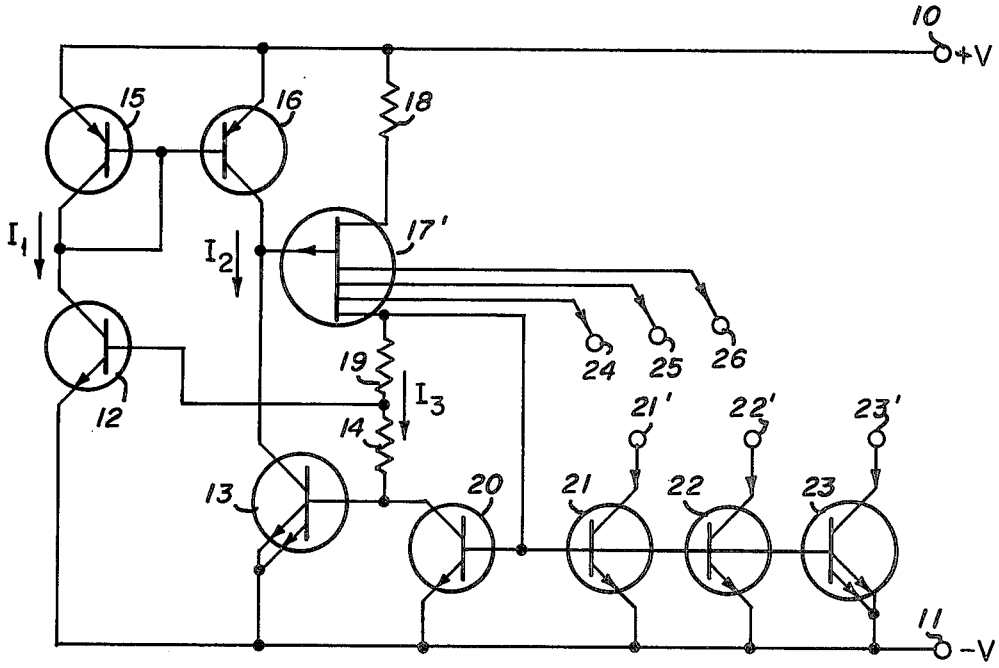
FIG. 2 is a schematic diagram showing the circuit of the invention in combination with additional current control elements.

FIG. 2 shows an alternative embodiment of the invention. The portions of the circuit that are similar to those of FIG. 1 bear the same element numbers. It will be noted that transistors 21, 22, and 23 have their base-emitter circuits in parallel with that of transistor 20. Accordingly, each of transistors 21–23 will sink a current at their respective terminals 21', 22', and 23'. In effect the circuit node represented by the base of transistor 20 is at a constant potential due to the constant value of $I_3$ as described above. If desired, one or more of the sink transistors, for example as shown in transistor 23, can have its emitter area ratioed with respect to that of transistor 20. In the instance illustrated transistor 23 can sink current in excess of $I_3$. Thus, the circuit of the invention can act as a reference source for other current sink transistors in an associated IC.

JFET 17' is shown as having a plurality of drain electrodes. $I_3$ will flow in the lower drain as described above and this is a constant current. The other drains will each be capable of passing a current that is related to its size with respect to the size of the lower drain. This means that terminals 24, 25, and 26 can then be current sources with the actual current sourcing capability being a function of the ratioing of drain size which is an easily controlled IC geometry function. The current sources can be employed to provide constant current supplies for other IC associated circuits.

One of the useful features of the invention is its self-starting characteristic. It does not require additional start-up circuitry as do many prior art circuits. When the circuit is initiated by the application of operating potential between terminals 10 and 11, JFET 17 will conduct. This will pull up the bases of transistors 12, 13, and 20. This causes transistor 15 to conduct which turns transistor 16 on and the circuit self-stabilizes due to the heavy negative feedback.

Another useful feature of the invention is its current economy. The actual useful constant current is $I_3$ which flows between terminals 10 and 11. It is stabilized and controlled by $I_1$ and $I_2$ which establish the $\Delta V_{BE}$ value. Since $I_1$ and $I_2$ can be made much smaller than $I_3$, little energy is wasted in the IC in regulating the constant current. Furthermore, the development of $I_3$ lends itself to the automatic control of additional current sinks and/or sources.

EXAMPLE

The circuit of FIG. 2 was constructed in IC form using conventional bipolar silicon fabrication technology. Resistors 14 and 19 were both made by diffusion and were nominally 1.5 Kohms each. Resistor 18 was 11 Kohms. Transistors 13 and 20 both had twice the area of transistor 12. Transistors 15 and 16 had the same areas so that $I_1$ was equal to $I_2$. In operation, it was found that $I_1=I_2=3$ microamperes. $I_3$ was 12 microamperes. In the design chosen the drains of JFET 17' were ratioed to source currents of 20, 25, and 60 microamperes. The value of $I_3$ varied by about 1% over an applied voltage range of $\pm 5$ to $\pm 15$ volts.

The circuit of the invention has been described and an example of its operation given. There are many alternatives and equivalents that will occur to a person skilled in the art that are within the spirit and intent of the invention. Therefore, it is intended that the scope of the invention be limited only by the following claims.

We claim:

1. A constant current circuit having first and second supply terminals between which a constant current flows substantially independent of the voltage developed across said first and second terminals, said circuit comprising:

a first transistor connected for passing a first control current and a second transistor connected for passing a second control current, each of said first and second transistors having an emitter, a base, and a collector;

means coupling said emitters of said first and second transistors together and to said first terminal;

current mirror means coupled between said second terminal and said collectors of said first and second transistors;

means for operating said first transistor at a higher current density than said second transistor;

amplifier means adapted to pass a third current and having an input and an output, said input being coupled to said current mirror and said output coupled to the bases of said first and second transistors to provide negative feedback around said first and second transistors; and means for controlling said third current as a function of the differential current density in said first and second transistors.

2. The circuit of claim 1 wherein said current mirror means is symmetrical whereby said first and second transistors pass the same current and said second transistor has a greater emitter area than the emitter area of said first transistor.

3. The circuit of claim 2 further comprising a resistance element coupled between said bases of said first and second transistors.

4. The circuit of claim 3 wherein said amplifier means comprises a junction field effect transistor having source and drain terminals coupled between said second terminal and said base of said first transistor, and a gate coupled to said current mirror means.

5. The circuit of claim 4 wherein said amplifier means further comprises a third transistor having an emitter coupled to said first terminal, a base coupled to said junction field effect transistor drain, and a collector coupled to said base of said second transistor.

6. The circuit of claim 5 wherein a resistor is employed to couple said junction field effect transistor to said base of said first transistor whereby the current flowing in said current mirror can be made smaller than the current flowing in said third transistor.

7. The circuit of claim 5 wherein said junction field effect transistor includes a plurality of drain electrodes, each one thereby providing a constant current source.

8. The circuit of claim 7 wherein said drain electrodes are ratioed thereby providing different value current sources.

9. The circuit of claim 5 wherein said circuit further comprises at least one additional transistor having emitter and base electrodes in parallel with the emitter and base electrodes of said third transistor whereby the collector of said additional transistor provides a current sink.

10. The circuit of claim 9 wherein said additional transistor has its emitter area ratioed with respect to the area of the emitter of said third transistor whereby said sink current is ratioed with respect to said third current.

11. The circuit of claim 10 wherein said resistance element is constructed to have a positive temperature coefficient of resistance thereby to temperature compensate said circuit.

* * * * *